United States Patent [19]

Gooch, Jr. et al.

[11] Patent Number: 5,007,326

[45] Date of Patent: Apr. 16, 1991

[54] CAST SINGLE PLATE P900 ARMOR

[75] Inventors: William A. Gooch, Jr., Bel Air; Matthew S. Burkins, Baltimore, both of Md.; Leo F. Mills, Bettendorf, Iowa; James W. Ogilvy, Detroit, Mich.; Antonio J. Ricchiazzi, Havre de Grace, Md.

[73] Assignee: The United States of America as represented by the Secretary of the Army, Washington, D.C.

[21] Appl. No.: 468,324

[22] Filed: Jan. 16, 1990

[51] Int. Cl.[5] ..... F41H 5/04

[52] U.S. Cl. ..... 89/36.02; 109/85

[58] Field of Search ..... 89/36.02, 36.03, 36.04, 89/36.11, 36.12, 36.14; 109/21.5, 49.5, 58, 58.5, 78, 80, 85

[56] References Cited

U.S. PATENT DOCUMENTS

| | | | |
|---|---|---|---|
| 2,380,393 | 7/1945 | Berg | 109/49.5 |
| 3,765,299 | 10/1973 | Pagano et al. | 89/36.08 |
| 4,036,104 | 7/1977 | Pagano et al. | 89/36.08 |
| 4,716,810 | 1/1988 | DeGuverd | 89/36.02 |
| 4,857,119 | 8/1989 | Karst et al. | 89/36.02 |

FOREIGN PATENT DOCUMENTS

| | | | |
|---|---|---|---|
| 209221 | 1/1987 | European Pat. Off. | 89/36.02 |
| 503320 | 6/1920 | France | 89/36.02 |
| 909792 | 5/1946 | France | 89/36.02 |
| 402515 | 12/1945 | Italy | 89/36.03 |
| 123214 | 2/1919 | United Kingdom | 109/58.5 |

OTHER PUBLICATIONS

Patz et al., "Metals Handbook", vol. 15, pp. 230–234.

*Primary Examiner*—Stephen C. Bentley

*Attorney, Agent, or Firm*—Saul Elbaum; Freda L. Krosnick

[57] ABSTRACT

A defensive applique armor for protecting a substrate which may be exposed to attack by projectiles. The armor comprises one or more cast metal plates of predetermined thickness which have slotted holes of various sizes and designs. The slotted holes are cast at obliquity.

To the slotted, cast metal armor an optional thin, cast metal layer may be added. Said layer may be positioned either within or external to the cast armor plate.

The invention encompasses both the armor and the process of making the same.

4 Claims, 4 Drawing Sheets

CAST SINGLE PLATE P900 ARMOR

RIGHTS OF THE GOVERNMENT

The invention described herein may be manufactured, used and licensed by or for the U.S. Government without payment to us of any royalty thereon.

BACKGROUND OF THE INVENTION

The present invention relates to a defensive applique armor for protecting a substrate which may be exposed to attack by projectiles. Among the substrates to be protected by the use of the present invention are land vehicles (i.e. tanks, trucks, personnel transport vehicles), air crafts (i.e. airplanes, helicopters) and oceanic vehicles (i.e.boats, submarines).

More particularly, the present invention relates to cast single or multiple plate applique armor panels to be placed over a substrate to be protected from projectile attack. Said panels having holes therein which are set at obliquity.

Many classes and forms of armor exist. The class of armor in which this invention is concerned deals with a curtain of numerous applique armor panels which are suspended a certain distance in front of a substrate to be protected. The applique armor acts as a barrier between the projectile and the substrate; and, the spaced distance between the applique armor panel and the substrate itself (hereinafter referred to as "stand-off ") permits further amplification of the armor barrier effect. This type of applique armor enables the substrate to be better able to absorb any remaining destructive effect of a projectile without severe damage to the substrate.

A specific type of armor which is well-known in the art is referred to generically as P900 armor. The P900 armors refer to a class of applique armors which consist of two metal plates of a predetermined thickness which are in a stacked configuration and which are spaced apart from one another. (See FIG. 1 which illustrates the prior art P900 armor.) said two-plate armor is further spaced a predetermined distance away from the substrate to be protected. Both of said metal plates have holes of various designs. These holes have been punched out or drilled in a perpendicular fashion through the armor plates. The holes in the two armor plates are arranged such that when a projectile penetrates the P900 plates, the projectile is broken due to the asymmetrical load placed on the projectile. The spacing to the substrate further amplifies projectile breakup which consequently allows the projectile effect to be more easily absorbed and withstood by the substrate.

The well-known prior art P900 armor has previously been fabricated only from annealed, wrought steel plates. Said plates are mechanically punched or drilled to form the holes and subsequently straightened, heat treated and cut to the desired shape and size. This prior art process of making the P900 armor carries with it many disadvantages. For example, the use of punching or drilling techniques is limited by the thickness of the steel plate and the design of the holes to be punched or drilled. Moreover, the punching or drilling techniques produce excessive amounts of waste of steel plate (approximately 60%). The punching or drilling techniques further create sharp edges on the armor plates which make their handling difficult.

The use of cast metal broadly in the armor art is not a novel concept. Note, Liable, "Ballistic Materials and Penetration Mechanics, "Chapter 7, pp. 145–167 (1980).

However, its use in fabricating a P900 type single plate armor of the present invention has neither been suggested nor done. The P900 type armor of the present invention further requires that its holes be set at obliquity. This limitation is further not suggested by Liable.

The use of the well-known "lost foam process " method of casting metals has not previously been used in the armor art. See. Metals Handbook, Volume 15 , pp. 230–234 ( 1988 ) . Hence, the method of making the armor of the present invention using said technique would be unobvious.

The use of a plurality of angled slots or louvers in applique armor constructions has been suggested in U.S. Pat. No. 3,765,299 and U.S. Pat. No. 4,036,104 (both issued to Pagano et al.). These patents teach a design commonly referred to in the art as a "ribbed applique." These patents, however, neither suggest the structure of the present invention nor the method of making the subject matter of the present invention.

The concept of applying an armor to a substrate wherein a stand-off distance is present between the two is taught in U.S. Pat. No. 2,380,393 (issued to Berg).

As one may note from the teachings in the prior art with regard to applique armors, the individual concepts of using cast metals, oblique angles and stand-off distances are not novel ones. Moreover, the general process of casting metals using the "lost foam method" is equally well known, although not in the armor art. The combination of these concepts are neither taught nor suggested in the prior art. The combination of these general concepts result in the armor of the present invention.

BRIEF SUMMARY OF INVENTION

This invention consists of a defensive applique armor for protecting a substrate which may be exposed to attack by projectiles. The armor comprises a cast metal plate or plates of predetermined thickness which have slotted holes of various sizes and designs. The slotted holes are sufficiently small so that a projectile is unable to pass therethrough without disrupting the armor. Moreover, the slotted holes of the defensive applique armor are cast at obliquity.

The cast armor of the invention may contain an optional thin, cast metal layer. Said optional layer may be positioned either within or external to the basic cast armor plate. The presence of an optional thin, cast metal layer provides reinforcement protection against any projectile effect and aids in the breakup of a projectile. In addition, the optional layer, if positioned external to the cast armor plate, serves to simplify cleaning and painting of the armor plate on that external surface. Onto said optional thin, cast metal layer an optional hard facing material may be placed. Exemplary materials for said hard facing material may include carbon cloth, tungsten carbide particles, FeCr coating, FeCr-/Mo/V surfacing, 1642 CrC surfacing or Ceramco $Cr_7C_3$.

The armor of the present invention may further comprise recessed pockets through which a bolt may be used to affix said cast armor to the substrate to be protected. Said bolts are attached to tubular spacers wherein one end of the tubular spacers is attached directly to the substrate and the other end is attached to the armor through bolting means. These tubular spacers provide a predetermined stand-off distance between the applique cast armor and the substrate. The recessed pockets are cast during the process of making the armor. Said recessed pockets provide an applique armor which is more easily stored than the original prior art P900 armor design.

The armor of the present invention is produced through the use of the well known "lost foam process." See *Metals Handbook*, Volume 15 , pp. 230–234 (1988 ). The well known process is adapted to be used in the present invention. This casting process encompasses creating a styrofoam master plate which would represent the structure of the applique armor within the scope of the present invention. Said styrofoam master plate is then coated with a commercially available sand slurry mixture which hardens onto the surface of the plate. Finally, a castable metal is poured down and along the coated styrofoam master plate. Said poured, castable metal replaces the styrofoam within the master and produces an exact copy of the styrofoam master plate. Hence, the name "lost foam process."

The use of any castable metal is within the scope of the present invention. Among the preferred castable metals which may be used are aluminum, steel, stainless steel and titanium.

Although only one cast single plate P900 armor may be needed to protect a substrate, a plurality of the same may be used. For instance, two of said armors may be stacked one on the other with a predetermined distance existing between them. The option, however, of using only one armor plate cuts down significantly on the mounting time needed to protect a substrate.

It is an object of the present invention to provide a cast single plate armor having holes set at obliquity.

It is a further object of the invention to provide a method of fabricating said single plate armor so as to reduce the cost of production, eliminate scrap waste material, incorporate a mounting mechanism and produce an armor having smoother edges.

It is a further object of the invention to produce an applique armor having holes, wherein said holes are not produced by a punching or drilling technique.

It is a further object of the invention to produce an applique armor which would reduce mounting time of the same.

Still a further object of the invention is to provide a defensive armor having a high performance against projectile attack.

Other objectives and features of the present invention will be apparent from the following detailed description of the invention, drawings and the claims.

DETAILED DESCRIPTION OF THE INVENTION

Figure 1:
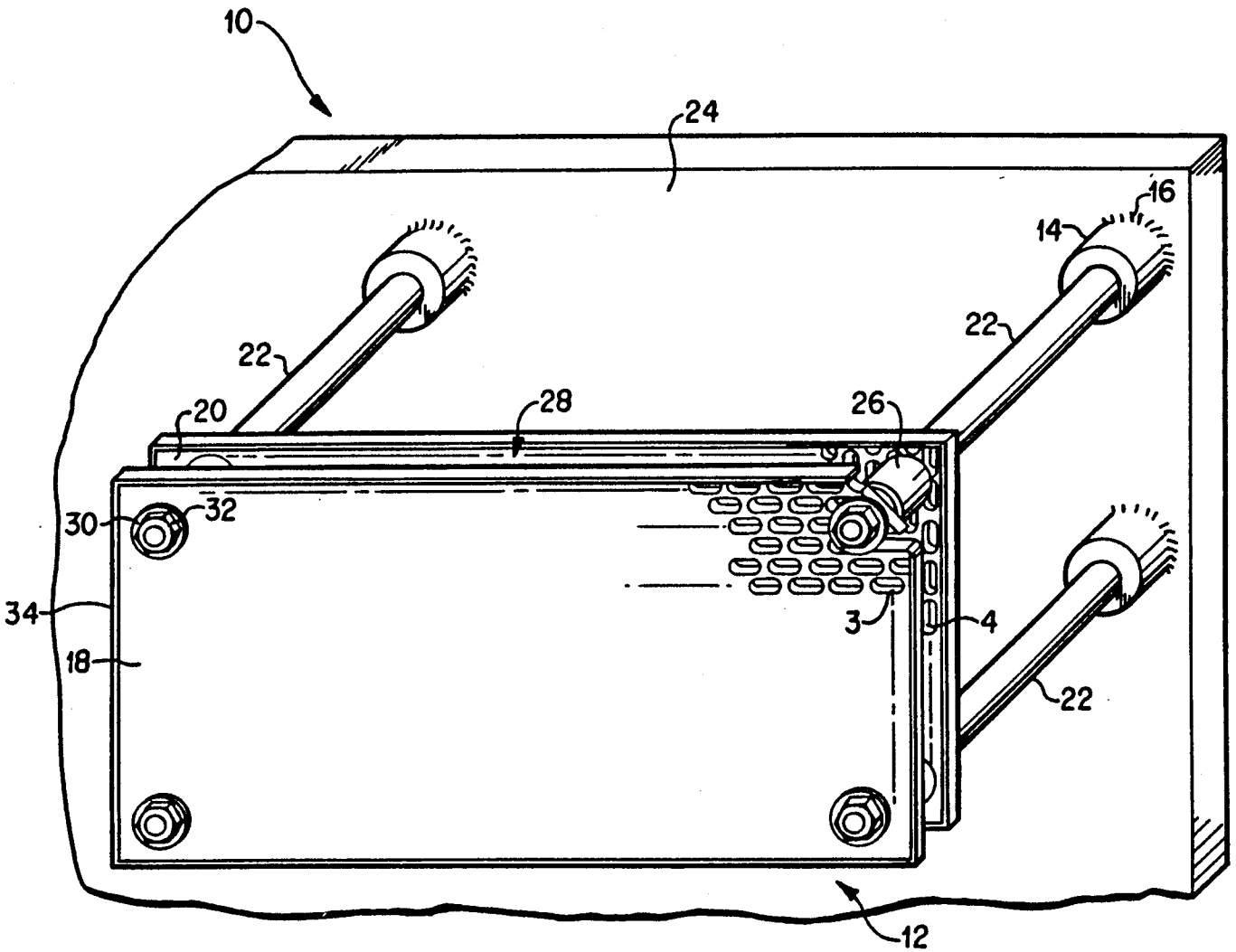
FIG. 1 is a perspective view of the prior art punched double-plate P900 armor mounted on a substrate. The holes are perpendicular to the plane of the armor.

In order to better understand the structure of the present invention, a detailed description of the prior art P900 armor is essential. FIG. 1, generally at 10, is representative of said prior art armor.

The applique armor of FIG. 1 comprises a plurality of P900 applique armor panels 18 and 20. Said panels have slotted holes 3 and 4 respectively. Said holes 3 and 4 have been punched perpendicular to the plane of the applique armor panels 18 and 20. Applique armor panel 18 has slotted holes 3 which are horizontally slotted. Applique armor panel 20 comprises slotted holes 4 which are vertically slotted. Plates 18 and 20 are aligned (not specifically shown) such that the slots of one applique armor plate and the non-slotted area (the space between the slots) on the second applique armor plate are lined up. This alignment causes an asymmetric loading to a projectile when impacting panels 18 and 20.

Tubular spacers 22 are designed to provide a predetermined stand-off space 24 between the inner applique plate 20 and the substrate 12. Tubular spacers 26 provide a specific predetermined stand-off space 28 between the P900 applique panels 18 and 20. These stand-off spaces 24 and 28 are fundamental to the prior art P900 armors.

The P900 armor of the prior art are affixed to substrate 12 by the use of threaded bosses 14 which may be affixed to substrate 12 by any conventional means, such as weld beads 16. The P900 armors 18 and 20 are attached to tubular spacers 26 and 22, which are threaded on their ends, by means of washer 30 and nut 32. Said attaching means protrudes past the surface of plate 18.

Along the perimeter of the P900 plates 18 and 20 are protective edge guards 34 which provide a safety covering/shield against sharp edges which result from the punching method used of making said plates.

Figure 2:
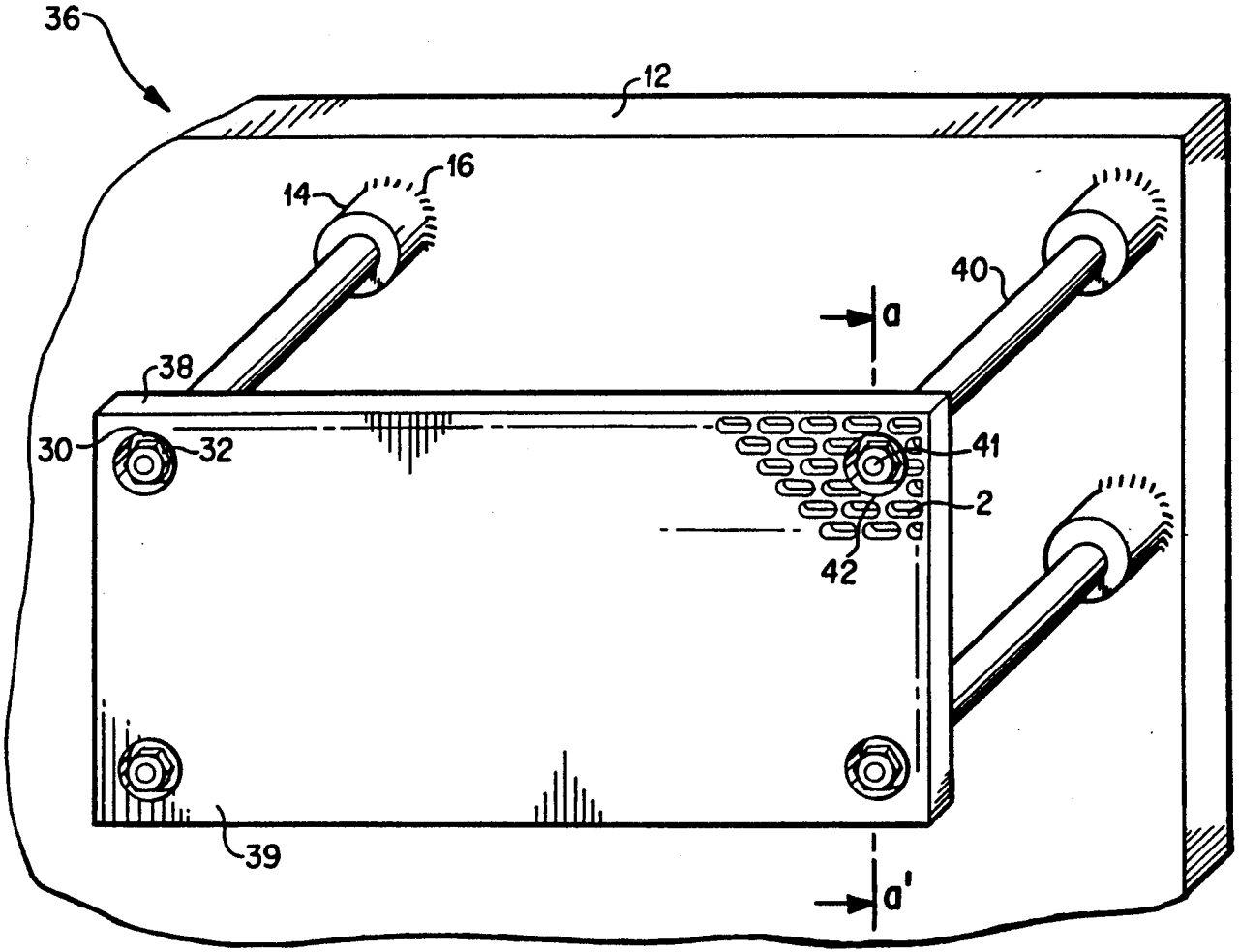
FIG. 2 is a perspective view of the cast single-plate slotted P900 armor of the present invention on a substrate. The slotted holes are set at obliquity.

FIG. 2 represents, generally at 36, an embodiment of a perspective view of the cast single-plate slotted P900 , armor of the present invention. The single-plate armor 38 comprises a plurality of slotted holes 2 which are set at obliquity. Armor 38 is produced by a casting method, as opposed to the prior art punching method described above. Armor 38 further has recessed pockets 42 through which tubular spacers 40 having threaded end 41 passes through. Said armor 38 is attached to substrate 12 through said tubular means 40 by washer 30 and nut 32. The nut and washer, 32 and 30 respectively, do not project past the exterior surface 39 of the P900 plate 38 of the present invention.

Figure 3:
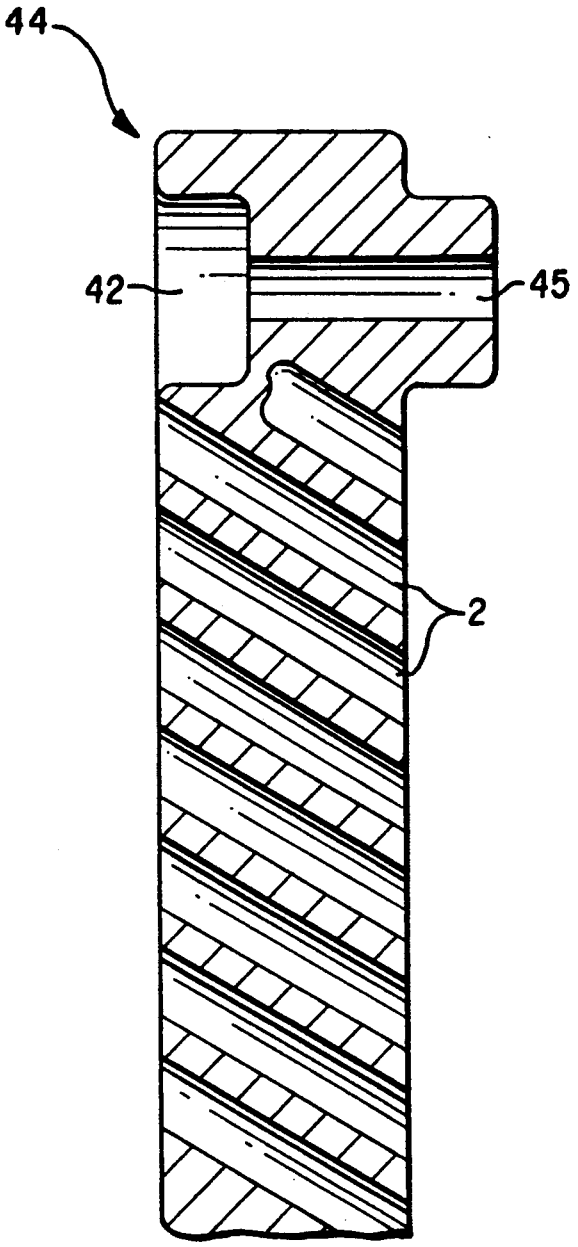
FIG. 3 is a cutaway cross-sectional view along reference points represented by aa' of the cast single-plate P900 design set forth in FIG. 2.

FIG. 3 represents a cutaway cross-sectional view along reference pionts aa' of FIG. 2. Said cross-sectional view is of the cast single-plate P900 armor 44 of the present invention. The armor 44 comprises a plurality of oblique slots 2. The angles of obliquity of said slots 2 may vary depending upon the type of penetrator one wishes to protect a substrate from. Said armor 44 further comprises recessed pocket 42 and opening 45 through which a tubular spacer 40 (see FIG. 2) may be accommodated.

Figure 4:
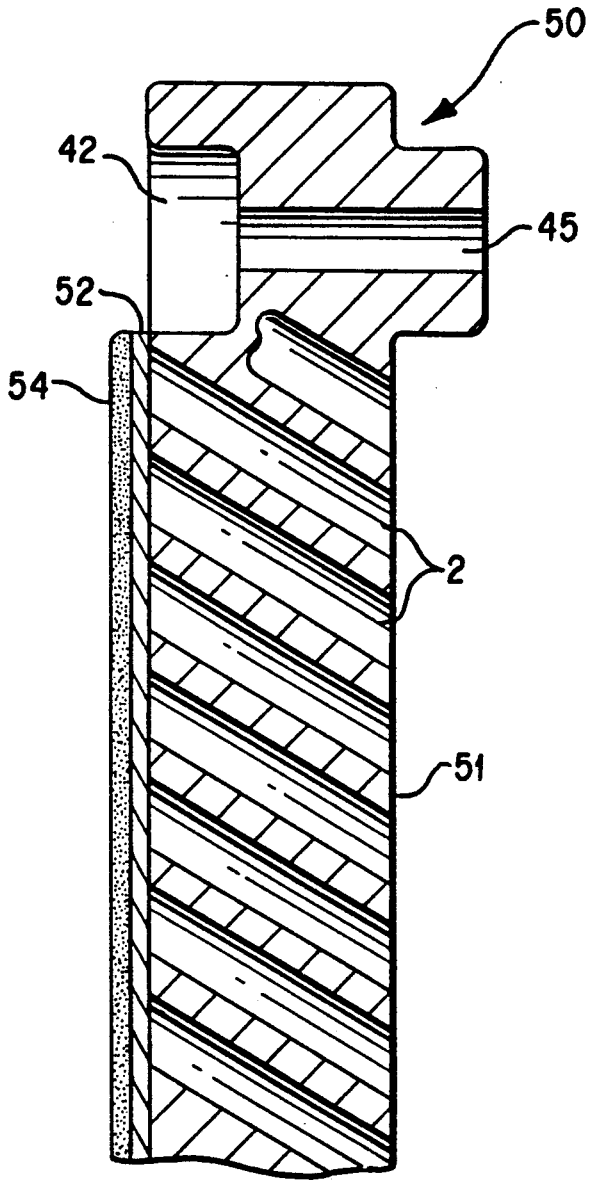
FIG. 4 is an additional embodiment of the invention as set forth in FIG. 3, but further comprising a thin metal layer and an optional hard surface material.

FIG. 4, generally at 50, represents a further embodiment of the cast single-plate P900 armor of the present invention. This embodiment can further improve the ballistic performance of the armor. It also makes painting and cleaning the outer surface 52 of said armor easier. In this embodiment, a thin-skin of metal 52 is concurrently cast over the oblique slots 2.

Onto thin-skin of metal 52, a further embodiment of an optional hard surface material 54 can be placed. Said hard faced material 54 may be composed of carbon cloth, tungsten carbide particles, FeCr coating, FeCr-/Mo/V surfacing, 1642 CrC surfacing or Ceramo $Cr_7Cr_3$ surfacing. The hard faced material 54 is sintered to material 52 during the casting process. The use of said surface 54 aids in the breakup of a penetrator.

The thin-skin of metal 52 can optionally be placed either within the armor or on the rear surface therof 51.

The dimensions of the components of the cast single plate P900 armor of the present invention will vary based on the need of specific protection against specific types of projectiles. The overall dimension of the armor may range from about 8 inches to 36 inches in length and from about 8 inches to 60 inches in height and about 0.25 inches to about 3 inches in thickness.

The sizes of the slots which may be used in the present invention range from about 0.50 inches to about 2 inches in length by about 0.25 inches to about 1 inch in width. The web, defined as the solid material between the slots, can vary in thickness from about 0.10 inches to 1 inch. The number of slots, for example, per square foot, may be within the range of about 15 to 680 slots/-square foot. This number, however, may be left for the skilled artisan to determine. Said slots are arranged in a uniformed fashion. Moreover, the slots of the present invention are set in obliquity of up to about 60 degrees.

The cast single plate armor herein may be mounted onto a substrate wherein its stand-off distance ranges from about 5 inches to about 25 inches from the substrate to be protected.

The specific dimensions and parameters set forth above are merely representative figures. The dimensions of the P900 armor of the present invention are only limited by the size of the production facilities available.

EXAMPLE

The armor of the present invention may be produced and represented by the following:

Styrofoam master sheets having a thickness of about 0.50 inches and dimensions of about 14 inches by about 30 inches are used. Said styrofoam sheets have slots in a regular pattern produced from a die. Said slots have the dimensions of 0.625 inches by 1.625 inches on 0.625 inch vertical centers and 1.625 inch horizontal centers. These slots are set at an obliquity of 30 degrees. The web, defined as the solid material between the slots, is about 0.150 inches in thickness.

These styrofoam master sheets are dipped into a commercially available sand slurry mixture as utilized in a conventional lost foam process. Said sand slurry is allowed to harden onto the master sheets. This sand slurry mixture is merely a temporary coating used to keep the shape of the styrofoam master during the lost foam casting process.

The sand slurry coated styrofoam masters are then placed in a sand flask and shaken. A vaccum is applied to the bottom of the sand flask.

A pouring gate is attached to the sand flask; and molten metal is poured down said gate. The molten metal flows down the sand slurry coated styrofoam master and replaces the styrofoam master.

The cast P900 armor plate is allowed to cool. The temporary sand slurry coating is then removed by striking the cast material with a hammer. The sand slurry coating is extremely brittle and readily separates from the cast material. The armor plate is then sand-blasted to clean and remove any casting residue.

The armor plate herein is later heat-treated to the desired hardness.

If a thin, metal outer or inner layer is wanted, said layer can be cast as part of the original design in the "lost foam process" master plate.

It is to be understood that the embodiments described and shown are given by way of example only, and that the armor element according to the invention can be the object of numerous other variants —i.e. size, shape, etc.

Although the invention has been described with reference to specific embodiments and drawings, it is to be understood that the invention is not limited to those precise embodiments, and that various changes and modifications may be effected by one skilled in the art without departing from the scope or spirit of the present invention.

We claim:

1. A defensive applique armor for covering and protecting a substrate which may be exposed to attack by projectiles:

said applique comprising a flat armor plate composed of castable metal having predetermined thickness and having a plurality of slotted holes;

said slotted holes being sufficiently small so that a projectile cannot pass therethrough;

said slotted holes being set at obliquity; and said applique further comprising a thin skin castable metal layer which increases the maintainability or protecting ability of said armor.

2. The defensive applique armor according to claim 1, wherein said thin skin castable metal layer is positioned external to the armor.

3. A method of providing anti-projectile armoring protection to a substrate comprising affixing to said substrate by the use of affixing means a defensive applique armor comprising a flat armor plate composed of castable metal having a predetermined thickness and having a plurality of slotted holes;

said slotted holes being sufficiently small so that a projectile cannot pass therethrough;

said slotted holes being set at obliquity; and said applique armor further comprising a thin skin castable metal layer which increases the maintainability or protecting ability of said armor.

4. The method in accordance with claim 3, wherein said thin skin castable metal layer is positioned external to the armor.

* * * * *